US011268786B2

(12) United States Patent
Moultrie

(10) Patent No.: US 11,268,786 B2
(45) Date of Patent: Mar. 8, 2022

(54) HOLSTER SYSTEM

(71) Applicant: SHTF GEAR LLC, Logan, UT (US)

(72) Inventor: Clay Thomas Moultrie, Bountiful, UT (US)

(73) Assignee: SHTF Gear LLC, Logan, UT (US)

( * ) Notice: Subject to any disclaimer, the term of this patent is extended or adjusted under 35 U.S.C. 154(b) by 0 days.

(21) Appl. No.: 16/942,012

(22) Filed: Jul. 29, 2020

(65) Prior Publication Data

US 2021/0025671 A1 Jan. 28, 2021

Related U.S. Application Data

(63) Continuation-in-part of application No. 29/699,655, filed on Jul. 26, 2019.

(51) Int. Cl.
*F41C 33/02* (2006.01)
*F41C 33/04* (2006.01)

(52) U.S. Cl.
CPC ..... *F41C 33/0209* (2013.01); *F41C 33/048* (2013.01)

(58) Field of Classification Search
CPC ..... F41C 33/02; F41C 33/0209; F41C 33/048
USPC ..... 224/682
See application file for complete search history.

(56) References Cited

U.S. PATENT DOCUMENTS

| | | | | |
|---|---|---|---|---|
| 6,814,270 | B2 | 11/2004 | Mason | |
| 7,314,152 | B1 * | 1/2008 | Garrett | F41C 33/0236 224/192 |
| D594,649 | S | 6/2009 | Zusman | |
| D601,339 | S | 10/2009 | Zusman | |
| 10,107,588 | B2 | 10/2018 | Rogers | |
| 10,184,754 | B2 * | 1/2019 | Laemmlen | H04B 1/3888 |
| 2014/0075650 | A1 * | 3/2014 | Garrison | F41C 33/02 2/300 |
| 2015/0027025 | A1 | 1/2015 | Mantua | |
| 2015/0285587 | A1 | 10/2015 | Abusaev | |
| 2019/0063870 | A1 * | 2/2019 | Tedder | F28F 13/003 |
| 2020/0018568 | A1 * | 1/2020 | Evans | F41C 33/04 |
| 2020/0116455 | A1 * | 4/2020 | Haggart | F42B 39/02 |

FOREIGN PATENT DOCUMENTS

DE 202013102184 U 8/2014

OTHER PUBLICATIONS

Gerber Holsters, Sidekick-Helix AIWB Holster, Nov. 7, 2018, https://www.gerberholsters.com/product/sidekick-helix-aiwb-holster/?v=402f03a963ba (Year: 2018).*

(Continued)

*Primary Examiner* — Corey N Skurdal
(74) *Attorney, Agent, or Firm* — Preston P. Frischknecht; Project CIP

(57) ABSTRACT

Embodiments of the present invention include a holster system comprising a first holster member configured to releasably hold a handgun, a second holster member configured to releasably hold an accessory such as a handgun magazine, knife, flashlight, or tourniquet and two or more semi-rigid connection members located between and connecting the first and second holster members, the connection members achieving an optimal balance between strength and flexibility and forming openings for providing ventilation.

26 Claims, 5 Drawing Sheets

(56) References Cited

OTHER PUBLICATIONS

Patriot Holsters, https://patriotholsters.net/products/appendix-carry-kydex-holsters-aiwb, Feb. 14, 2020.
Black Point Tactical, https://blackpointtactical.com/shop/dualpoint-aiwb-holster/, Feb. 14, 2020.
Quantum Carry, https://quantumcarry.com/products/centeriine-appendix-holster, Feb. 14, 2020.
J&D Firearms Inc., https://www.jdfirearms.com/blog/review-glock-magazine-pouch, Feb. 14, 2020.
Tier1concealed, https://www.tier1concealed.com/collections/iwb-holsters, Jul. 3, 2020.
Txcholsters, https://txcholsters.com/collections/build-your-own/products/threekit-x1-ally, Jul. 3, 2020.
Lasconcealment, https://lasconcealment.com/collections/products/products/ronin-3-0, Jul. 3, 2020.

* cited by examiner

HOLSTER SYSTEM

RELATED APPLICATIONS

This application is a continuation-in-part of, and claims priority to U.S. Design patent application Ser. No. 29/699,655, filed on Jul. 26, 2019.

BACKGROUND OF THE INVENTION

Various commercially available inside-the-waistband (IWB) holster systems provide separate, side-by-side holster components for retaining a handgun and handgun accessory—such as a magazine, knife, flashlight, or tourniquet. One subset within this category is appendix-type holsters designed to be worn by a user in the front of the waistband. Some of these systems connect the handgun and handgun accessory portions with solid brackets, lace, or similar means. Such connections may be either too rigid or too yielding, thereby negatively affecting holster performance and user comfort.

For example, rigid brackets and/or connections keep the holster components secure as the handgun and/or handgun accessory is holstered and withdrawn. However, the rigidity of this structure detracts from user comfort by creating resistance to the dynamic contours of a user's body, especially during movement. Softer connection materials such as lace better facilitate user comfort by yielding to dynamic user body contours, but they also hinder holster performance because holster portions are less secured to each other. Another side effect of the design of many of these systems is that they occupy a large among of surface area of the user's body and fail to provide adequate ventilation.

What is needed is an IWB, appendix-style, side-by-side system with holster compartments having a connection that balances strength and flexibility within a structure that also provides for enhanced breathability with respect to a user's body.

SUMMARY OF THE INVENTION

In accordance with the above, a new and innovative holster system is provided. The problem of balancing strength and flexibility within an IWB side-by-side that provides for enhanced breathability is solved. Embodiments of the present invention include a holster system comprising a first holster member configured to releasably hold a handgun, a second holster member configured to releasably hold an accessory such as a handgun magazine, knife, or flashlight; and two or more semi-rigid connection members located between and connecting the first and second holster members, the connection members achieving an optimal balance between strength and flexibility and forming openings for providing ventilation.

These and other aspects of the present invention will become more fully apparent from the following description and appended claims or may be learned by the practice of the invention as set forth hereinafter.

BRIEF DESCRIPTION OF THE FIGURES

To further clarify the above and other aspects of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The drawings may not be drawn to scale. The invention will be described and explained with additional specificity and detail through the use of the accompanying drawings in which.

DETAILED DESCRIPTION OF THE ILLUSTRATED EMBODIMENT

The present invention in its various embodiments, some of which are depicted in the figures herein, is a holster system.

Figure 1:
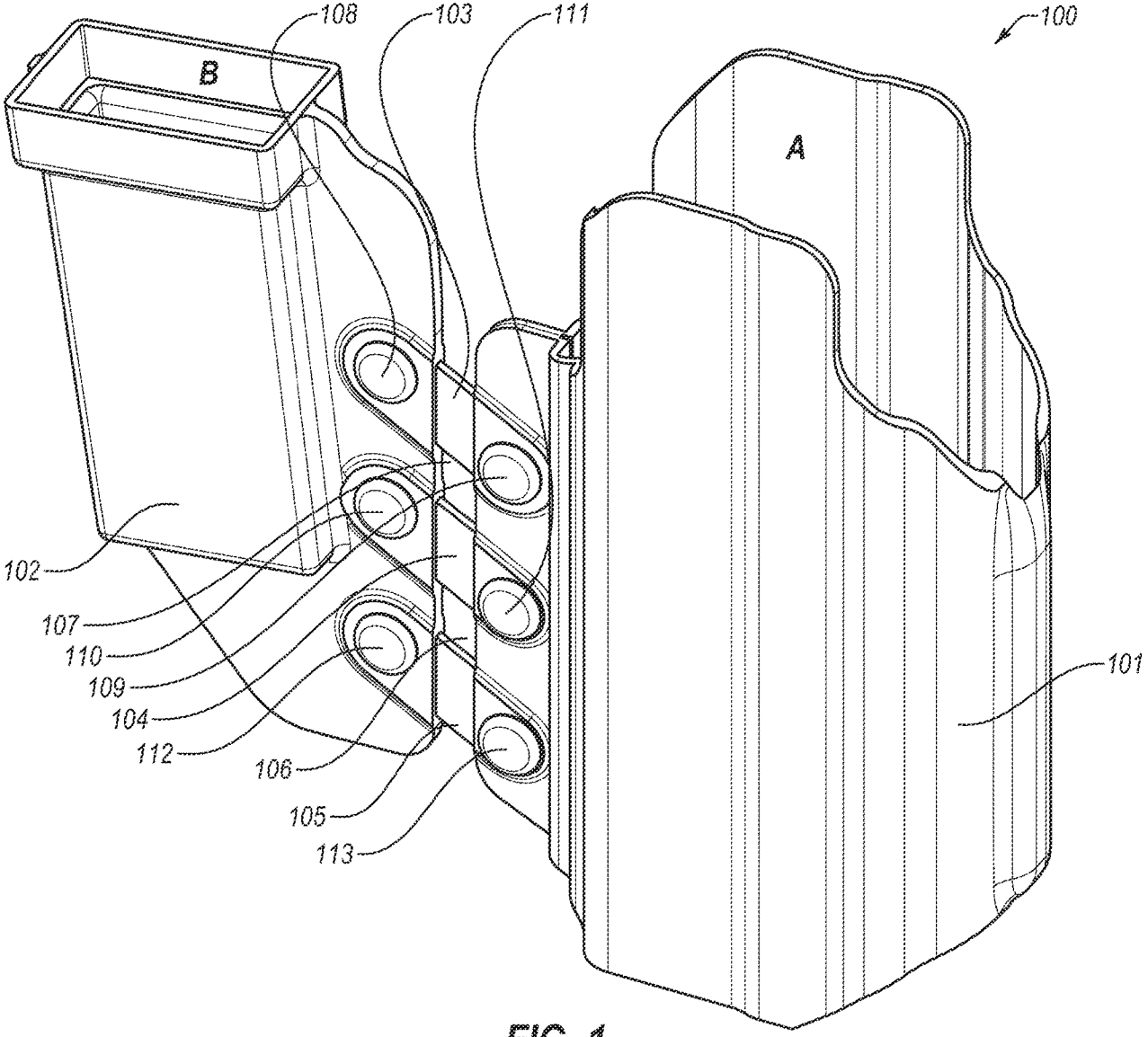
FIG. 1 is a first perspective view of one embodiment of the holster system.

Referring now to FIG. 1, the holster system 100 is comprised of a first holster member 101 configured to releasably hold a handgun, a second holster member 102 configured to releasably hold an accessory like a handgun magazine, knife, flashlight, or tourniquet; and semi-rigid connection members 103, 104, 105 located between and connecting the first 101 and second holster members 102. The holster system 100 of the illustrated embodiment is designed to be worn inside a user's waistband and is of the appendix-type.

In various embodiments, first 101 and/or second 102 holster members are substantially of Kydex; ABS (acrylonitrile butadiene styrene); PVC (polyvinyl chloride); PVC/Acrylic; nylon (polyamide); PC (polycarbonate); acrylic (PMMA—polymethyl methacrylate); HDPE (high density polyethylene); HIPS (high impact polystyrene); PIE (polyetherimide); PETG (polyethylene terephthalate glycol); PP (polypropylene); and TPO (thermoplastic polyolefin).

Figure 2:
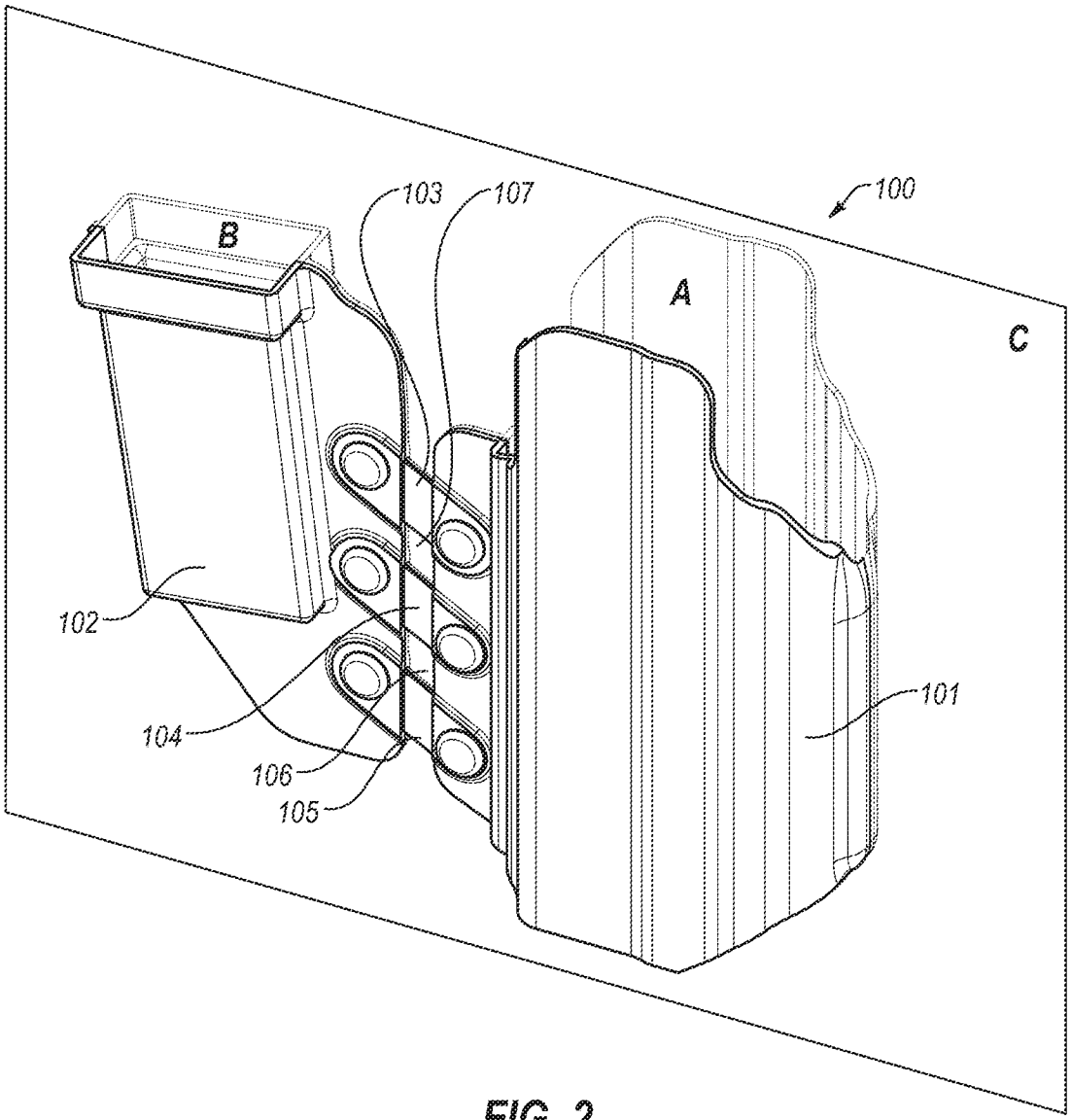
FIG. 2 is a second perspective view of one embodiment of the holster system with a frontal plane.
Figure 3:
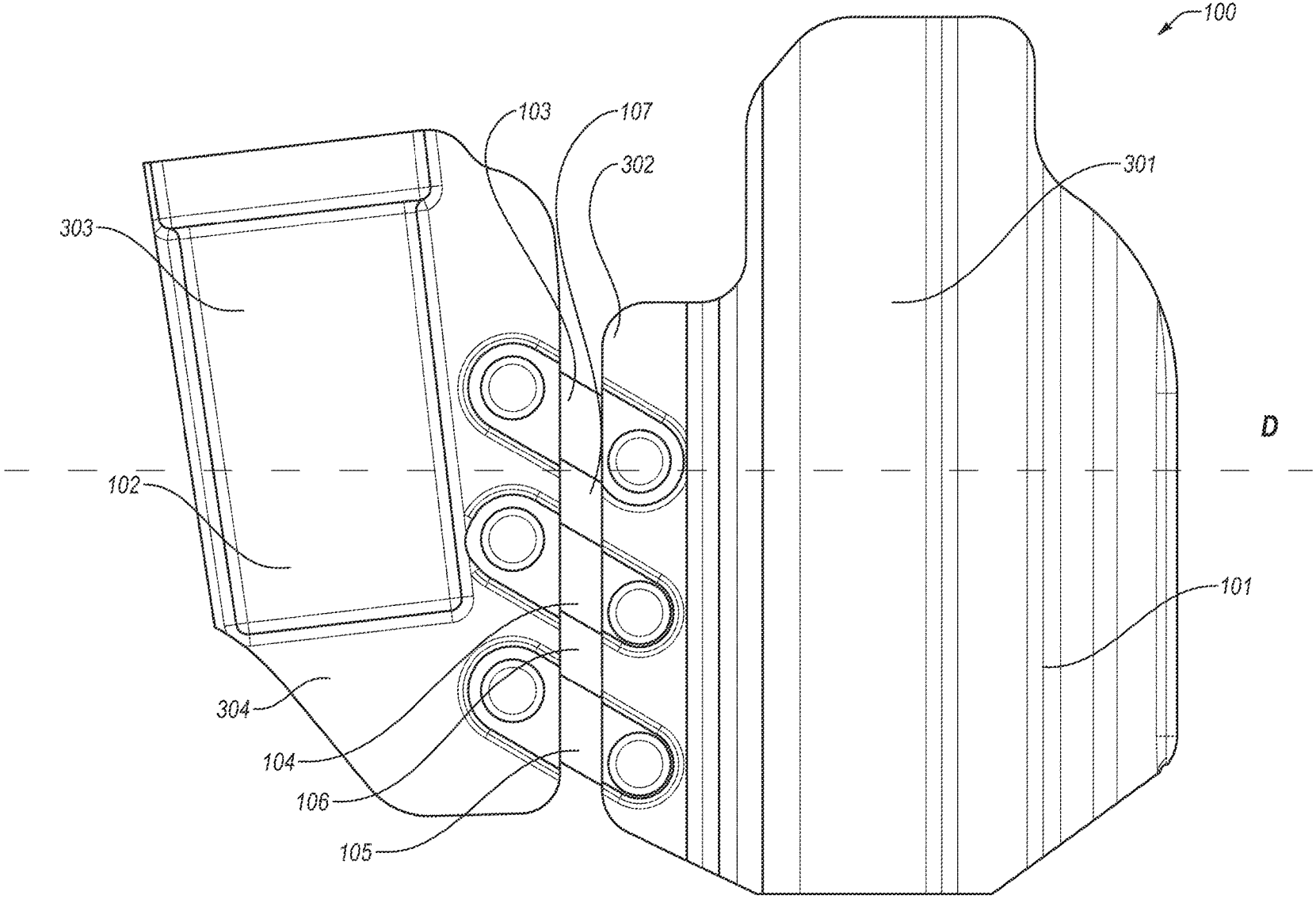
FIG. 3 is a side view of one embodiment of the holster system.

Referring now to FIG. 2, the number of semi-rigid connection members 103, 104, 105 varies across embodiments but, in preferred embodiments, there are two or more such members. Semi-rigid connection members 103, 104, 105 are generally elongate and generally located within a frontal plane C and/or center of the holster system 100. Each semi-rigid connection member may be located below and/or above another. Referring briefly to FIG. 3, semi-rigid connection members may be positioned at an angle with respect to a horizontal axis D of the first 101 and second 102 holster members. Semi-rigid connection members 103, 104, 105 may also be positioned such that they form one or more openings 106, 107 between the first 101 and second 102 holster members for providing ventilation with respect to a user's body when the holster system 100 is in use.

Figure 4:
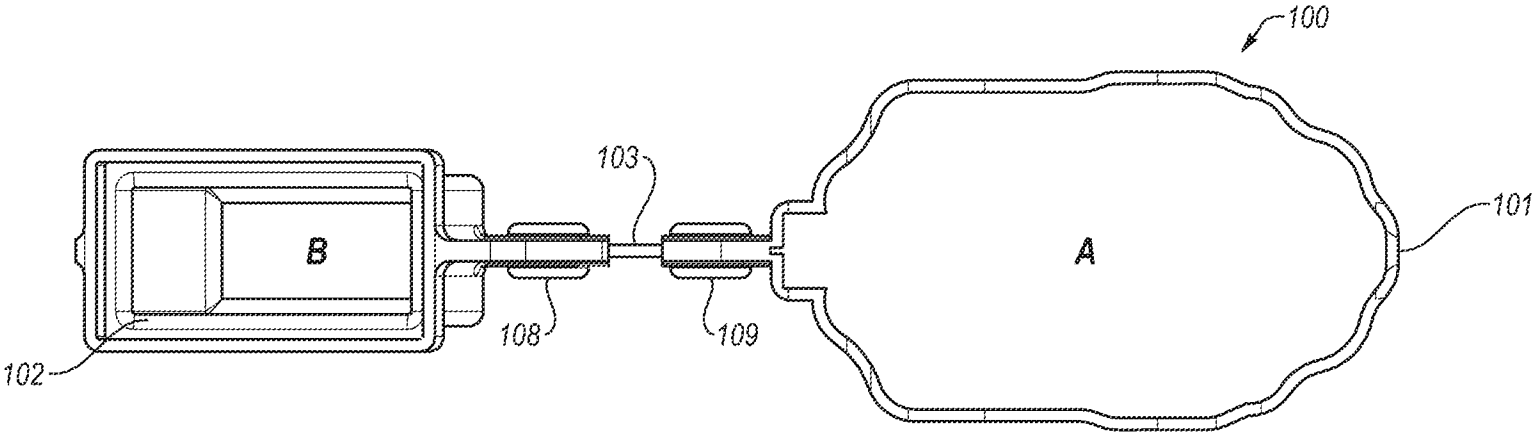
FIG. 4 is a top view of one embodiment of the holster system.
Figure 5:
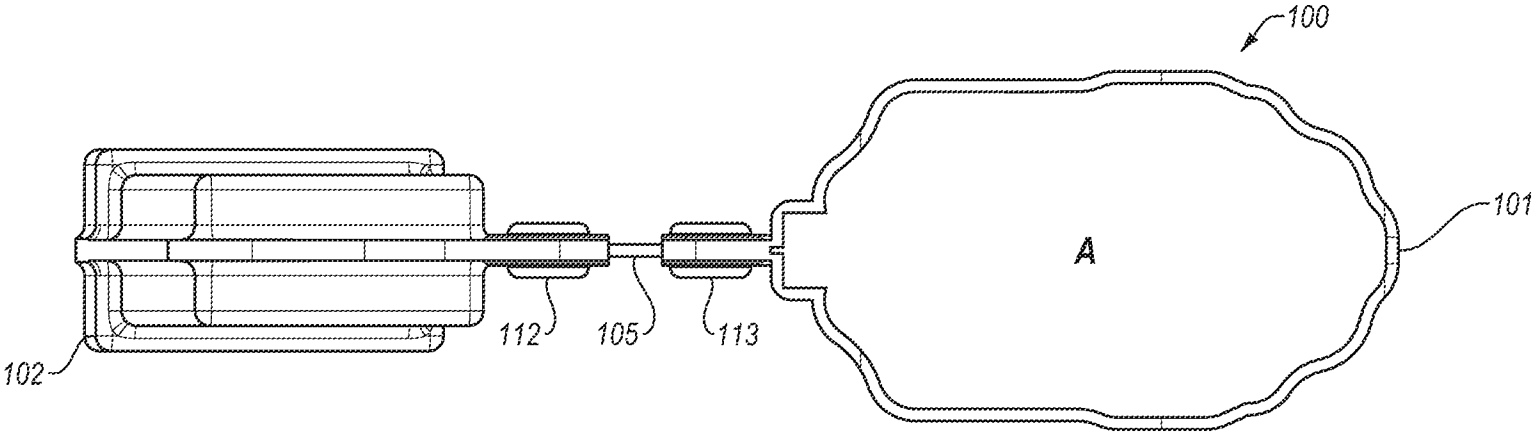
FIG. 5 is a bottom view of one embodiment of the holster system.

Referring briefly to FIGS. 4 and 5, in many embodiments, ends of semi-rigid connection members 103, 104, 105 are configured to connect within each of the first 101 and second 102 holster members, through means such as metal fasteners 108, 109, 112, 113. Notably, the semi-rigid connection members 103, 104, 105 need not be co-planar with first 101 and second 102 holster members; rather, in various embodiments either or both of first 101 and second 102 holster members may be canted with respect to the semi-rigid connection members and/or each other.

Semi-rigid connection members 103, 104, and 105 are typically not formed from first 101 and/or second 102 holster members. Rather, semi-rigid connection members 103, 104, 105 are separate components from first 101 and/or second 102 holster members and made of a material to balance strength and flexibility in the connection between first 101 and second 102 holster components. By way of example, one such suitable material is polymer-coated webbing, although any number of other materials may also be suitable for achieving the required balance between strength and flexibility.

Figure 6:
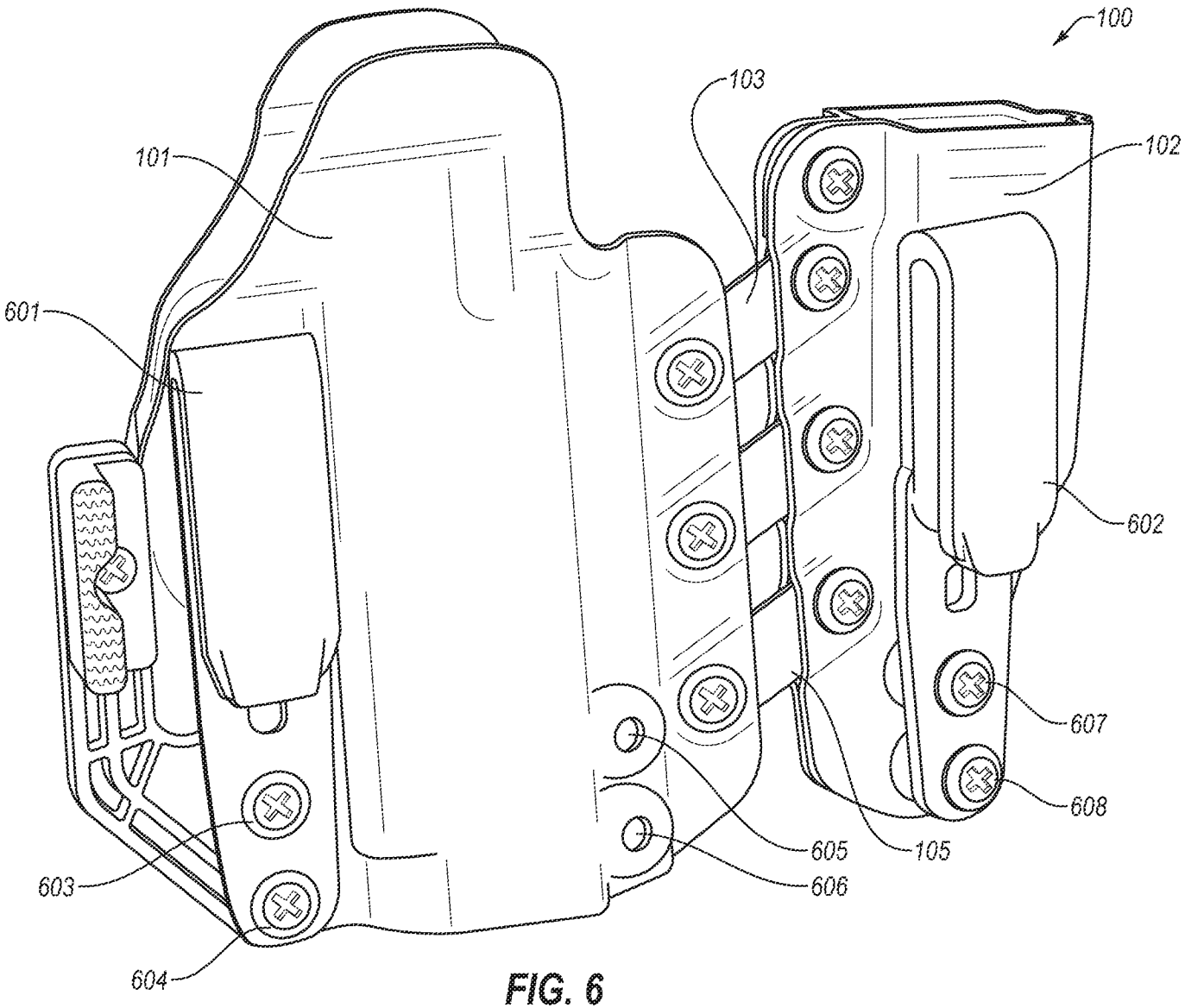
FIG. 6 is a third perspective view of one embodiment of the holster system.

Referring now to FIG. 6, the holster system 100 may also include two or more mounting clips 601, 602 for attaching the holster system 100 to a user's waistbelt. Mounting clips 601, 602 may be releasably attached and repositionable with respect to the first 101 and second 102 holster members through a series of apertures and fasteners, 603 through 608, that provide ambidextrous configuration.

Thus configured, the problem of achieving an IWB, appendix-style, side-by-side system with holster compartments having a connection that balances strength and flexibility within a structure that also provides for enhanced breathability is solved.

The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A holster system comprising:

a first holster member configured to releasably hold a handgun;

a second holster member configured to releasably hold an accessory selected from the group of a handgun magazine, a knife, a flashlight, and a tourniquet; and two or more semi-rigid connection members located between and connecting the first and second holster members, at least one of the two or more semi-rigid connection members positioned at at least one of an obtuse and acute angle with respect to a horizontal axis of the first and second holster members.

2. The holster system of claim 1, further configured to be worn inside a user's waistband.

3. The holster system of claim 1, the two or more semi-rigid connection members generally located within a frontal plane of the holster system.

4. The holster system of claim 1, the two or more semi-rigid connection members comprised of a first semi-rigid connection member located above a second semi-rigid connection member.

5. The holster system of claim 1, wherein the two or more semi-rigid connection members are not formed from the first or second holster members.

6. The holster system of claim 1, wherein the first and second holster members are substantially of one of the following: Kydex; ABS (acrylonitrile butadiene styrene); PVC (polyvinyl chloride); PVC/Acrylic; nylon (polyamide); PC (polycarbonate); acrylic (PMMA—polymethyl methacrylate); HDPE (high density polyethylene); HIPS (high impact polystyrene); PIE (polyetherimide); PETG (polyethylene terephthalate glycol); PP (polypropylene); and TPO (thermoplastic polyolefin).

7. The holster system of claim 1, the two or more semi-rigid connection members forming one or more openings between the first and second holster members for providing ventilation with respect to a user's body when the holster system is in use.

8. A holster system comprising:

a first holster member configured to releasably hold a handgun;

a second holster member configured to releasably hold an accessory selected from the group of a handgun magazine, a knife, a flashlight, and a tourniquet; and two or more semi-rigid connection members located between and connecting the first and second holster members, the two or more semi-rigid connection members substantially of polymer-coated webbing material.

9. The holster system of claim 8, further configured to be worn inside a user's waistband.

10. The holster system of claim 8, wherein the first and second holster members are substantially of one of the following: Kydex; ABS (acrylonitrile butadiene styrene); PVC (polyvinyl chloride); PVC/Acrylic; nylon (polyamide); PC (polycarbonate); acrylic (PMMA—polymethyl methacrylate); HDPE (high density polyethylene); HIPS (high impact polystyrene); PIE (polyetherimide); PETG (polyethylene terephthalate glycol); PP (polypropylene); and TPO (thermoplastic polyolefin).

11. The holster system of claim 8, the two or more semi-rigid connection members attached to the first and second holster members with fasteners.

12. A holster system comprising:

a first holster member configured to releasably hold a handgun;

a second holster member configured to releasably hold an accessory selected from the group of a handgun magazine, a knife, a flashlight, and a tourniquet; and two or more polymeric semi-rigid connection members located between and connecting the first and second holster members, the two or more polymeric semi-rigid connection members having ends that terminate within holster members.

13. The holster system of claim 12, further configured to be worn inside a user's waistband.

14. The holster system of claim 12, the two or more polymeric semi-rigid connection members comprised of a first polymeric semi-rigid connection member located above a second polymeric semi-rigid connection member.

15. The holster system of claim 12, the two or more polymeric semi-rigid connection members forming one or more openings between the first and second holster members for providing ventilation with respect to a user's body when the holster system is in use.

16. The holster system of claim 12, the two or more polymeric semi-rigid connection members attached to the first and second holster members with fasteners.

17. A holster system comprising:

a first holster member configured to releasably hold a handgun;

a second holster member configured to releasably hold an accessory selected from the group of a handgun magazine, a knife, a flashlight, and a tourniquet; and two or more polymeric semi-rigid connection members located between and connecting the first and second holster members, the two or more polymeric semi-rigid connection members substantially of a first material and the first and second holster members substantially of a second material.

18. The holster system of claim 17, further configured to be worn inside a user's waistband.

19. The holster system of claim 17, the two or more polymeric semi-rigid connection members comprised of a first polymeric semi-rigid connection member located above a second polymeric semi-rigid connection member.

20. The holster system of claim 17, the two or more polymeric semi-rigid connection members forming one or more openings between the first and second holster members for providing ventilation with respect to a user's body when the holster system is in use.

21. The holster system of claim 17, the two or more semi-rigid connection members attached to the first and second holster members with fasteners.

22. A holster system comprising:

a first holster member configured to releasably hold a handgun;

a second holster member configured to releasably hold an accessory selected from the group of a handgun magazine, a knife, a flashlight, and a tourniquet; and two or more polymeric semi-rigid connection members located between and connecting the first and second holster members, the two or more polymeric semi-rigid connection members forming one or more openings between the first and second holster members for providing ventilation with respect to a user's body when the holster system is in use.

23. The holster system of claim 22, further configured to be worn inside a user's waistband.

24. The holster system of claim 22, the two or more polymeric semi-rigid connection members comprised of a first polymeric semi-rigid connection member located above a second polymeric semi-rigid connection member.

25. The holster system of claim 22, the one or more openings between the first and second holster members.

26. The holster system of claim 22, the two or more semi-rigid connection members attached to the first and second holster members with fasteners.

* * * * *